US007209673B2

(12) United States Patent
Suzuki et al.

(10) Patent No.: US 7,209,673 B2
(45) Date of Patent: Apr. 24, 2007

(54) IMAGE FORMING APPARATUS

(75) Inventors: Shinya Suzuki, Toride (JP); Hideaki Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 11/018,858

(22) Filed: Dec. 22, 2004

(65) Prior Publication Data

US 2005/0147425 A1 Jul. 7, 2005

(30) Foreign Application Priority Data

Dec. 26, 2003 (JP) ..... 2003/433950

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS 6,013,403 A * 1/2000 Ichikawa ..... 430/97
6,631,249 B2 10/2003 Katsumi et al. ..... 399/71
6,640,077 B2 10/2003 Suzuki et al. ..... 399/303

FOREIGN PATENT DOCUMENTS

JP 2000-231279 8/2000

* cited by examiner

*Primary Examiner*—Vincent Q. Nguyen
(74) *Attorney, Agent, or Firm*—Fitzpatrick, Cella, Harper & Scinto

(57) ABSTRACT

In an image forming apparatus a forming unit forms an image using a light color toner and a dark color toner having the same hue as the light color toner. A patch image is formed with the light color toner and the dark color toner, and has different image density level portions. In the patch image, a difference in image density levels between adjacent image density level portions in a transition range before and after a switching region between a range in which either one of the light color toner or the dark color toner is used and a range in which both of the light color toner and the dark color toner are used is smaller than a difference in image density levels in the other ranges. Densities of the patch image are detected and the image density is controlled in accordance with a detected output.

2 Claims, 10 Drawing Sheets

IMAGE FORMING APPARATUS

FIELD OF THE INVENTION AND RELATED ART

The present invention relates to an image forming apparatus which forms an image through an electrophotographic process. In particular, it relates to an image forming apparatus such as a copying machine, a printer, a facsimileing machine, or the like.

As one of the electrophotographic image forming apparatuses such as a copying machine, a laser beam printer, etc., a full-color image forming apparatus which forms a full-color image by depositing in layers a plurality of monochromatic images different in color, more specifically, yellow Y, magenta (M), cyan (C), and black (Bk) images, is known.

For the formation of a high quality image with use of a full-color image forming apparatus such as the above described one, density control is important, which regulates the apparatus in terms of the maximum and intermediary levels of density for monochromatic yellow (Y), magenta (M), cyan (C), and black (Bk) images so that the apparatus will remain consistent in terms of the image density level, regardless of the difference in manufacture tolerance and changes in ambient conditions. Therefore, it is customary to equip a full-color image forming apparatus with a density controlling means for controlling the apparatus in terms of image density.

There have been proposed various full-color image forming apparatuses equipped with a density detecting means. Some of them (for example, one disclosed in Japanese Laid-open Patent Application No. 2000-231279) are provided with a plurality of image bearing members and a plurality of developing means. Further, at least two of the plurality of developing means are identical in the hue of the developer (toner) therein, but are different in density (saturation or deepness) of the developer (toner) therein. The developer in one of the two developing means is the same in hue as the developer in the other developing means, but is lower in density than the developer in the other developing means. They employ an image forming method in which each of the plurality of monochromatic images formed to form a single full-color image is formed of a combination of two monochromatic images identical in spectral properties. That is, a monochromatic image formed of the above-mentioned developer lower in color density level (which hereinafter will be refeffed to as light color toner), and a monochromatic image formed of the above-mentioned developer higher in color density level (which hereinafter will be referred to as deep color toner), using two kinds of lookup tables, that is, a lookup table A for the light color toner, and a lookup table B for the deep color toner, shown in FIG. 13.

According to the lookup tables in FIG. 13, the low density areas of the monochromatic image are primarily formed of the light color toner, and the mid density areas of the monochromatic image are formed of the mixture of the light and deep color toners. Further, the high density areas of the monochromatic image are primarily formed of the deep color toner. Therefore, controlling the image forming apparatus with reference to these lookup tables A and B makes it possible to form an image which does not suffer from the problem that the low density areas of an image appear grainy due the low dot density, and also, to reduce the amount of toner which is consumed for the formation of the high density areas of an image. In other words, controlling the image forming apparatus with reference to these lookup tables improves the image forming apparatus in terms of image quality by reducing the graininess level at which the low density areas of an image are formed. It also effective to expand the range in which an image is accurately formed in terms of color reproduction.

However, the above-described image forming method suffers from the following problem. That is, as a large number of images are formed, that is, the image forming apparatus is repeatedly used a large number of times, changes occur to various conditions under which an image is formed; changes occur to the developing means in terms of development properties, the thickness of the dielectric layer of the photosensitive drum, the transfer efficiency, etc. Changes also occur to the ambient conditions. As these changes occur, the light color toner and the deep color toner change in the γ properties, and the occurrence of this change in the γ property coffesponds to the threshold value for the input video signal, below which the light color toner is used, and above which the deep color toner is used. Therefore, the linearity in the relationship between the values of input video signals and the density level of the corresponding areas of the resultant image is lost. As a result, a defective image is formed, for example, an image defective in that the areas of the image, which are intermediary in density, are unnatural in gradation, and an image defective in that it has pseudo-contours.

SUMMARY OF THE INVENTION

The present invention can provide an image forming apparatus capable of an image higher in quality than an image forming apparatus in accordance with the prior art.

The present invention can also provide an image forming apparatus superior to an image forming apparatus in accordance with the prior art, in that it is capable of an image superior in reproducing the transitional areas of the image. The transitional areas are transitional in that the image density changes from the level to be reproduced with the use of the light color toner to the level to be reproduced with the use of the deep color toner.

These and other objects, features, and advantages of the present invention will become more apparent upon consideration of the following description of the-preferred embodiments of the present invention, taken in conjunction with the accompanying drawings.

DETAILED DESCRIPTION OF THE PREFERRED EMBODIMENTS

Hereinafter, the image forming apparatuses in accordance with the present invention will be described in detail with reference to the appended drawings.

Embodiment 1

Referring to FIGS. 1–9, the first embodiment of the present invention will be described.

Figure 1:
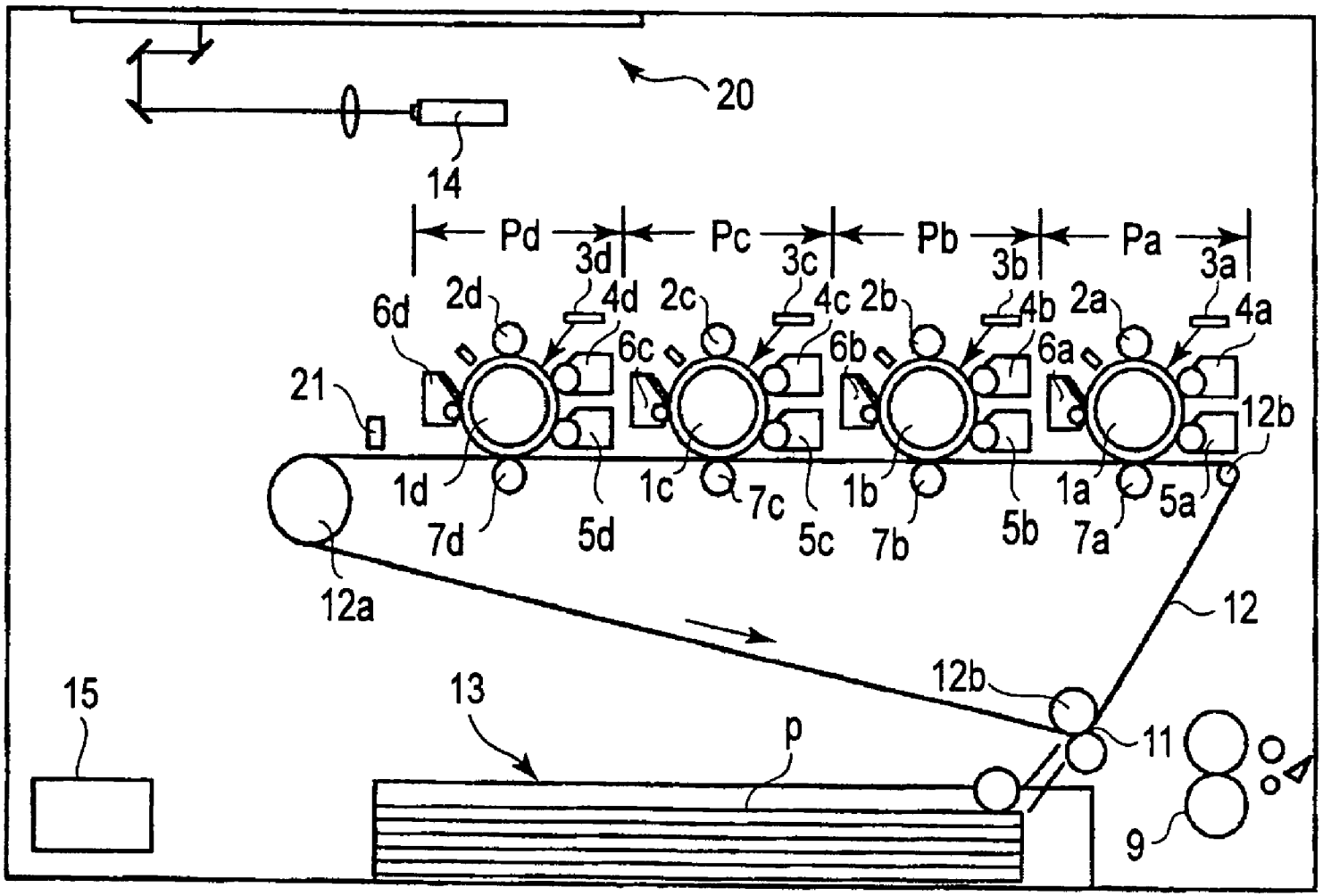
FIG. 1 is a schematic sectional view of the image forming apparatus in the first embodiment of the present invention, showing-the general structure thereof.

Referring to FIG. 1, the image forming apparatus in this embodiment has four processing stations (image forming stations) P (Pa, Pb, Pc, and Pd) as image forming means for forming monochromatic yellow (Y), magenta (M), cyan (C), and black (Bk) images on the four image bearing members, one for one. The four processing stations are aligned straight in the direction in which a recording medium is conveyed. Each processing station has a photosensitive drum 1 (1*a*, 1*b*, 1*c*, and 1*d*), a charging apparatus 2 (2*a*, 2*b*, 2*c*, and 2*d*), an exposing apparatus 3 (3*a*, 3*b*, 3*c*, and 3*d*), a primary developing means 4 (4*a*, 4*b*, 4*c*, and 4*d*), a second developing means 5 (5*a*, 5*b*, 5*c*, and 5*d*), a cleaning apparatus 6 (6*a*, 6*b*, 6*c*, and 6*d*), and a primary transferring means 7 (7*a*, 7*b*, 7*c*, and 7*d*) as a transferring means. The image forming apparatus is provided with an intermediary transfer member 12 as a transferring means for transferring, in coordination with the primary transferring apparatuses 7, the toner images onto a recording medium p. The intermediary transfer member 12 is stretched between the photosensitive drum 1 and primary transferring apparatus 7, in each processing station, and is circularly moved in the direction indicated by an arrow mark.

In this image forming apparatus structured as described above, each of the four image forming stations for forming the four monochromatic toner images, that is, the monochromatic yellow (Y), magenta (M), cyan (C), and black (Bk) toner images, one for one, is provided with two developing means, that is, the first and second developing means 4 and 5; two developing means are provided per color. More specifically, the first and second developing means are identical in the color (hue) of the toners therein, but are different in the color density of the toners therein. That is, the first developing means 4 is filled with such developer that is the same in hue, but is lighter in color density (saturation) than the toner in the second developing means 5.

In other words, the image forming apparatus in this embodiment has two developing means, the deep color developing means 5 and light color developing means 4, for each of the four colors, yellow (Y), magenta (M), cyan (C), and black (Bk). The deep color developing means 5 and light color developing means 4 are the same in the hue of the toner of the developer they contain, but are different in the color density (saturation) of the toner of the developer they contain. The color of the toner in the second developing means 5 is darker (deeper) than that in the first developing means 4.

When it is said that two ordinary toners, which primarily are a mixture of resin and coloring component (pigment), are the same in hue, but different in density (saturation), it usually means that the two toners are practically the same in the spectral characteristics of the coloring component (pigment), but are different in the amount of the coloring component. The "light color toner" of the two toilers which are the same in color (hue) is the one which is lower in color density (saturation).

The image forming apparatus in this embodiment uses two toners different in color density in order to form a monochromatic toner image of a given color, and the two toners different in color density used for forming a single monochromatic toner image may sometimes be referred to as "dense (dark) toner" and "light toner".

When two toners are said to be the same in hue, it means that the two toners are the same in the spectral characteristics of the coloring component (pigment) as described above. In the following description of the present invention, however, it means that the two toners are the same in terms of the ordinary concept of color. For example, two toners may be said to be the same in hue in that both are of magenta, cyan, yellow, or black color.

In the following description of the present invention, when one of the two toners of the same hue is referred to as light color toner, it means that when the amount by which this toner is deposited on recording medium is 0.5 mg/cm$^2$, the portion of the recording medium covered with this toner is no more than 1.0 in optical density after the image fixation, whereas the portion of the recording medium covered with the other toner, or the deep color toner (toner more saturated in color) is no less than 1.0 in optical density.

In this embodiment, the amount of the pigment in the deep color toner is adjusted so that when the amount by which the deep color toner is deposited on recording medium is 0.5 mg/cm$^2$, the optical density of the recording medium covered with this toner is 1.6, whereas that for the light color toner is 0.8. These two toners different in color density (saturation) are used in various ratios to reproduce a desired level (gradation level) of color density.

In terms of the direction, indicated by an arrow mark, in which the photosensitive drum 1 is rotated, the first developing means 4 is located upstream of the second developing means 5.

The normal image forming steps carried out to form an image, by the image forming apparatus structured as described above are as follows.

In each of the plurality of process stations P, a toner image, which is different in color from the toner images in the other processing stations P, is formed on the photosensitive drum 1 through the electrophotographic process (comprising: charging, exposing, and developing steps).

First, in each processing station P, the charging step, in which the peripheral surface of the photosensitive drum 1 is uniformly charged by the charging apparatus 2 as a charging means, is carried out.

Meanwhile, in each processing station P, image formation data are read by an image reading portion 20, are processed by a controlling means 15 as the controller for controlling the image forming operation, and are transmitted to a laser driver 3 (3*a*, 3*b*, 3*c*, and 3*d*), which is a part of the exposing apparatus as a latent image forming means for forming a latent image on the photosensitive drum 1.

In this embodiment, an original is read twice by the original reading portion 20, for each processing station. More specifically, when the original is read for the first time, the obtained image formation data are processed by the controlling means 15 into the video signals for the first developing means 4, whereas when the original is read for the second time, the obtained image formation data are processed by the controlling means 15 into the video signals for the second developing means 5. The flowchart which shows the essential steps of this process of outputting the video signals is given in FIG. 2

First, regarding the first reading of an original for the formation of a latent image (exposure of photosensitive drum 1), the original placed on the original reading portion 20 is scanned (s1), and the optical data obtained from the original are converted (s1) by a CCD 14 into electrical signals, which are converted (s3) by an A/D conversion apparatus into digital signals. The thus obtained digital signals are processed (s4) by the image formation data processing block, and the R, G, and B signals are converted (s5) in color into CMYK signals. Then, the CMYK signals are subjected to the γ correction step (s6), and are converted (s7) into the video signals for the light color toner, in accordance with the lookup table (which hereinafter will be referred to as "LUT"). Then, the video signals for the light color toner are digitized (s8). The thus obtained digital image formation data are stored (s9), are converted (s10) into analog signals, are transferred to the laser driver 3, and are used (s11) for image formation. The LUT for the light color toner, which is used in the above described step s7, is represented by the line indicated by a referential letter A, in FIG. 8.

The electrostatic latent image formed through the exposure in the above described step (s11) is developed by the first developing means 4 which uses the light color toner. Then, the toner image formed by the first developing means 4 is transferred (primary transfer) onto the intermediary transfer belt 12 by the primary transferring apparatus 7 as a transferring means.

Then, the original is scanned for the second time (s12). In order to form a toner image of the deep color toner after forming a toner image of the light color toner, it is necessary to read (scan) the original again due to a requirement related to the memory. The image formation signals obtained by the second scanning of the original are processed through steps (s12–s17) similar to the steps through which the image formation signals obtained by the first scanning of the original are processed, up to the correction step. Thereafter, the signals are converted (s18) into the signals for the deep color toner, in accordance with the LUT for the deep color toner, and then, are digitized (s19). The thus obtained digital image formation data are stored (s20), are converted (s21) into analog signals, are transfeffed to laser driver 3, and are used to drive (s22) the laser driver 3 to form an image of the deep color toner. The LUT to be used in the step (s18) to obtain the signals for the deep color toner is represented by the line indicated by a letter B in FIG. 8.

As the above described step s22, or the latent image formation step, is carried out, an electrostatic latent image is formed, through the exposure, on the uniformly charged peripheral surface of the photosensitive drum 1. Next, this electrostatic latent image is developed through the developing step carried out by the second developing means 5 which uses the deep color toner, yielding a toner image formed of the deep color toner The thus obtained toner image is transferred (primary transfer) by the primary transferring apparatus 7, onto the intermediary transfer belt 12, onto which the toner image formed of the light color toner has been transferred. As a result, a toner image formed of the deep color toner and light color toner is yielded on the intermediary transfer belt 12.

Figure 2:
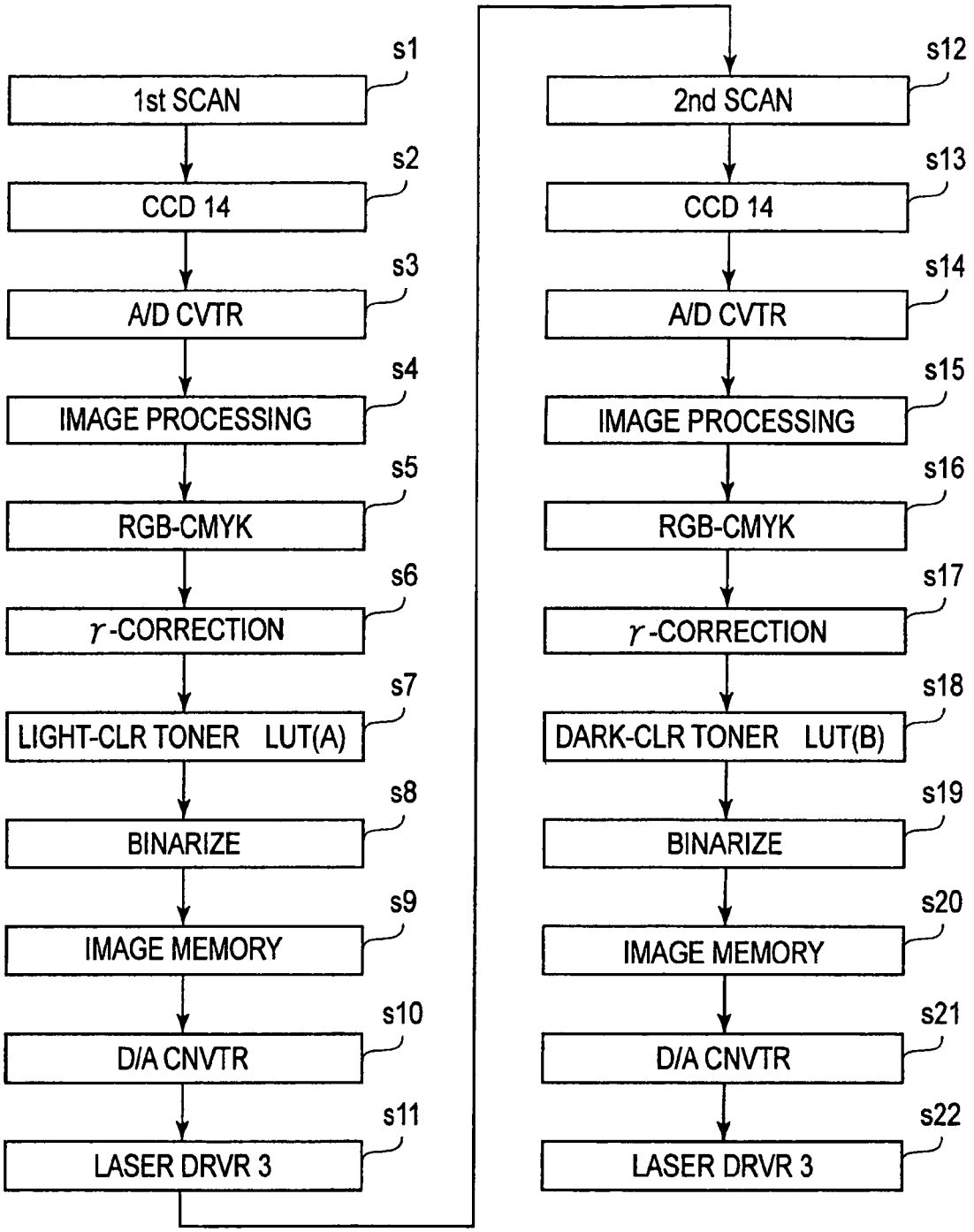
FIG. 2 is a flowchart which shows the flow of video signals in the image forming apparatus in the first embodiment.

In other words, through the video signal processing steps shown in FIG. 2, the original is sorted into the areas which are to be reproduced with the use of only the light color toner, the areas which are to be reproduced with the use of both the light and deep color toners, and the areas which are to be reproduced with the use of only the deep color toner. Then, whether only one of the developing means 4 and 5 is to be used, or which developing means is to be used if only one of the developing means 4 and 5 is to be used, is determined based on the results of the sorting.

As for the transferring means, the intermediary transfer member 12 is circularly moved by the suspensive rollers 12*a* and 12*b* at the same speed as the rotational velocity of each of the plurality of photosensitive drums 1, through the contact area (nip) between the primary transferring apparatus 7 and photosensitive drum 1, in each processing station P (Pa, Pb, Pc, and Pd), with its outwardly facing surface, in terms of the loop which the intermediary transfer member 12 forms, kept in contact with the peripheral surface of the photosensitive drum 1. Thus, as the intermediary transfer member 12 is moved sequentially through the plurality of primary transfer stations, the toner image formed on the peripheral surface of the photosensitive drum 1, of the two toner images formed in layers on the peripheral surface of the photosensitive drum 1, of the two toners different in color density, in each processing station P (Pa, Pb, Pc, and Pd) is transferred in layers onto the intermediary transfer member 12. This yields a single multicolor image, which is conveyed, while remaining on the intermediary transfer member 12, to the secondary transfer station 11, by the circular movement of the intermediary transfer member 12.

The multicolor image formed on the intermediary transfer member 12, of the plurality of monochromatic toner images formed of the two toners different in color density, in the plurality of processing stations P, one for one, is transferred (secondary transfer) in the secondary transfer station 11, onto the recording medium p delivered to the secondary transfer station 11 from the sheet feeder cassette 13, and then, is fixed to the recording medium p by the fixing apparatus 9. Thereafter, the recording medium p is discharged as a final product (copy) from the image forming apparatus.

In other words, according to the flowchart of FIG. 2, the image formation signals are processed, in the step s7, in accordance with the LUT for the light color toner, so that the areas of the image, which are low in color density, are primarily developed with the light color toner. As a result, the latent image is developed so that a monochromatic image, the low color density areas of which are lower in the color density of each dot, will be yielded. In other words, the flowchart makes it possible to minimize the shortcoming of a digital image in that a digital image may appear grainy. Further, another set of image formation signals are processed, in step s18, in accordance with the LUT for the deep color toner. In other words, according to the flowchart in FIG. 2, two monochromatic images different in color density are formed per color component (into which the optical image of an original is separated), through two sets of image formation steps, that is, the image formation signal processing step, latent image forming step, and developing step, and are transferred in layers onto the intermediary transfer belt 12, through the primary transfer step. This yields a single monochromatic image formed of two monochromatic images formed of the deep and light color toners, one for one, which are the same in hue and different in color density.

Described next will be the control to be carried out to form a satisfactory image, regardless of the changes in the apparatus conditions attributable to the usage and the changes in the ambient conditions, through an image forming process such as the one described above, in which two developing means different in the color density of the toners they use are used per color component. In this embodiment, the image forming process is controlled by revising the LUTs used for processing the video signals.

To describe in more detail, the above described image forming apparatus is reset so that the image formation conditions, such as the conditions under which the photosensitive drums 1 are charged and exposed by the image forming means, the conditions under which a latent image is developed, and the conditions under which a toner image is transferred, are set to the defaults. Then, the data for generating the video signals for forming density level detection test patches, which are stored in the ROM or the like, are read by the means for forming the electrostatic latent images for density level detection test, that is, a density level detection test patch forming means, for example, the controller (controlling means) 15, and a desired image density level is inputted. Then, the electrostatic latent image for density level detection test, which reflects the inputted image density level is formed, and is developed by the developing means to be used for developing the latent image in accordance with the intended image. As a result, the image of the density level detection test patch (images to be used for devising LUT) is formed, and is transferred (primary transfer) onto the intermediary transfer medium 12. Then, the color density level of the toner image of the density level detection test patch on the intermediary transfer member 12 is detected by the density detecting means (density sensor) 21, which is positioned upstream of the second transfer station 11, in terms of the moving direction of the intermediary transfer member 12, so that it faces the intermediary transfer belt 12. The thus obtained density level of the image of the density level detection test patch is used as the output density level.

Then, based on the relationship between the inputted color density level, and the outputted color density level detected by the color density sensor 21, the controller 15 as a controlling means adjusts the image formation conditions, as will be described below, in order to yield a satisfactory image. More specifically, the gradation reference, which in this embodiment is the LUT, set in the video signal processing portion of the controller 15, is revised so that a satisfactory (vivid) image, in terms of gradation, is always formed regardless of the gradational variations.

Figure 3:
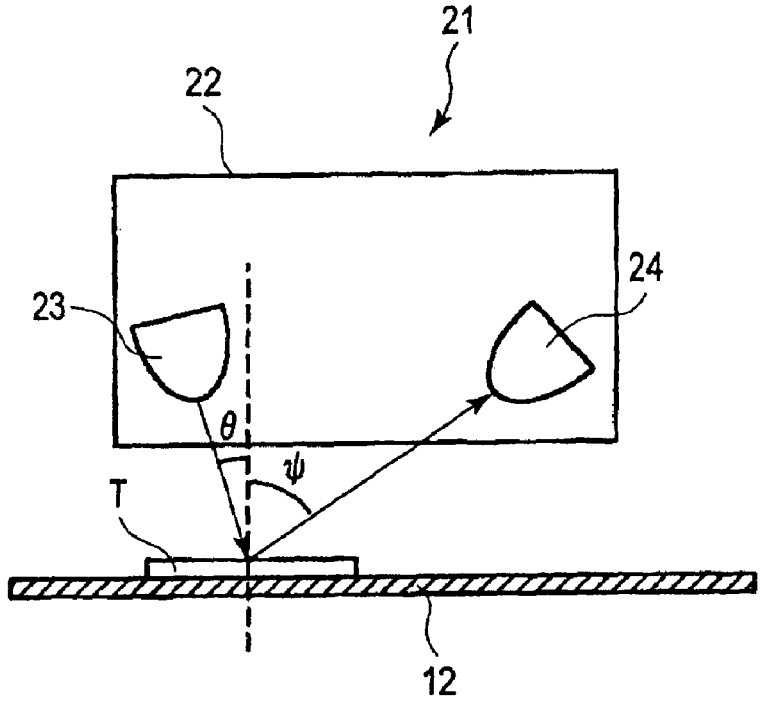
FIG. 3 is a schematic drawing of an example of a density detecting means in accordance with the present invention.
Figure 4:
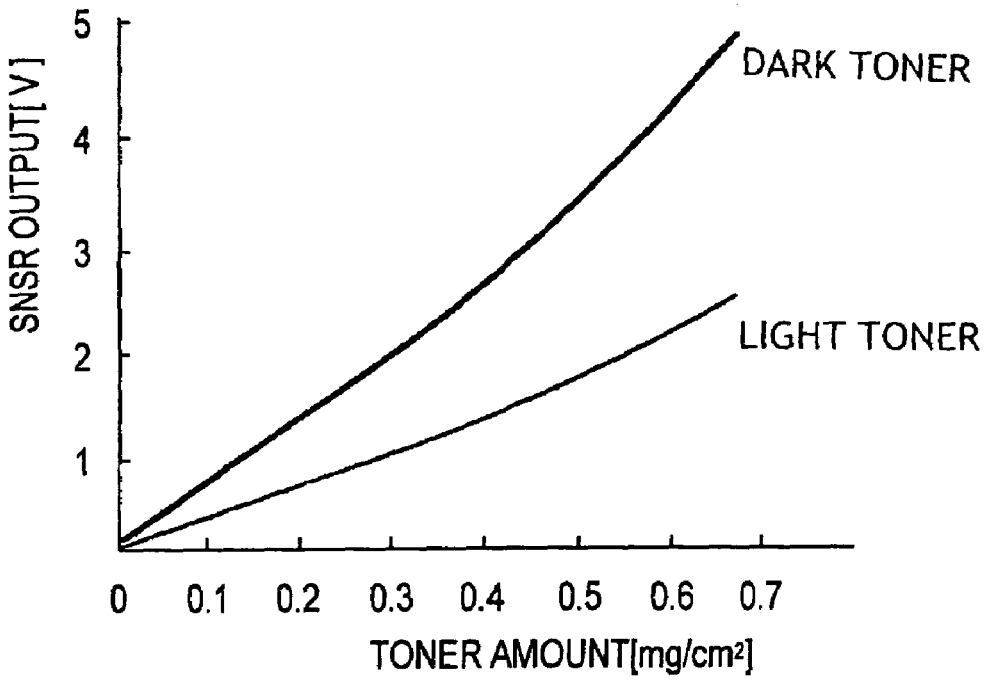
FIG. 4 is a graph showing the relationship between the amount of the light color toner on the medium, and the output of the density detecting means, and the relationship between the amount of the deep color toner on the medium, and the output of the density detecting means.

Refeffing to FIG. 3, the density sensor 21 in this embodiment compnses a light emitting element 23, a light receiving element 24 such as a photo-diode, Cds, or the like, and a holder 22 to which the light emitting element 23 and light receiving element 24 are attached. The beam of light from the light emitting element 23 is projected onto the image T of the density detection patch (which hereinafter will be refeffed to as patch image T) on the belt 12, and is partially received by the light receiving element 24 after being deflected (diffused) by the patch image T, in order to measure the density level of the patch image T. Generally, light reflected by a given surface includes the portion literally reflected by the surface and the portion diffused by the surface. In this embodiment, a density sensor of the diffuse light type is used as the density sensor 21, and the incident angle $\theta$ and reflection angle $\phi$ are set to 15° and 45°, respectively. The outputs of the density sensor 21 when the light color toner was used, and the outputs of the density sensor 21 when the deep color toner was used, are shown in FIG. 4.

The controlling means 15 automatically revises the gradation setting, in real time, by changing the values set in the lookup table stored in the $\gamma$ correcting portion of the video signal processing portion, based on, for example, a LUT revision table, in response to the image density level of the patch image T detected by the density sensor 21.

Figure 5:
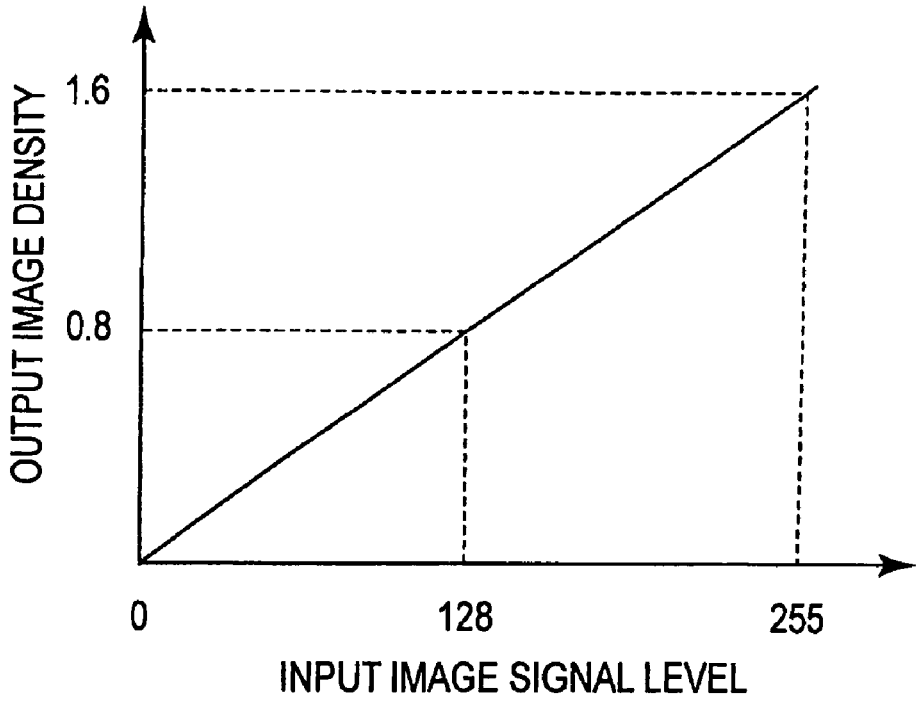
FIG. 5 is a graph showing the relationship between the values of the input video signals, and the density levels of the images resultant from the input video signals, after the adjustment of the input video signals based on the lookup tables.

Further, the controlling means 15 stabilizes the image forming apparatus in terms of image quality, by sequentially revising the image formation conditions, that is, the conditions under which the photosensitive drums 1 are charged, the conditions under which the photosensitive drums 1 are exposed, the conditions under which images are transferred, etc., which are set in the video signal processing portion. In other words, the controlling means 15 stabilizes the image forming apparatus in terms of image quality by revising the image formation conditions. Since the image forming apparatus is controlled in image density, based on the LUT revised through the above described steps, the relationship between the input video signals and the density of the image resultant from the inputted video signals becomes linear, as shown in FIG. 5, making it possible to yield an image satisfactory in terms of density level reproduction. Referring to FIG. 5, incidentally, the input video signals means the video signals resulting from the reading of the original by the original reading apparatus 20, and the output image density level means the density level of the image resulting from the input video signals.

As described above, in this embodiment, the image formation operation is controlled by the controlling means 15 in accordance with the LUT. Therefore, a satisfactory image can be formed.

Figure 6:
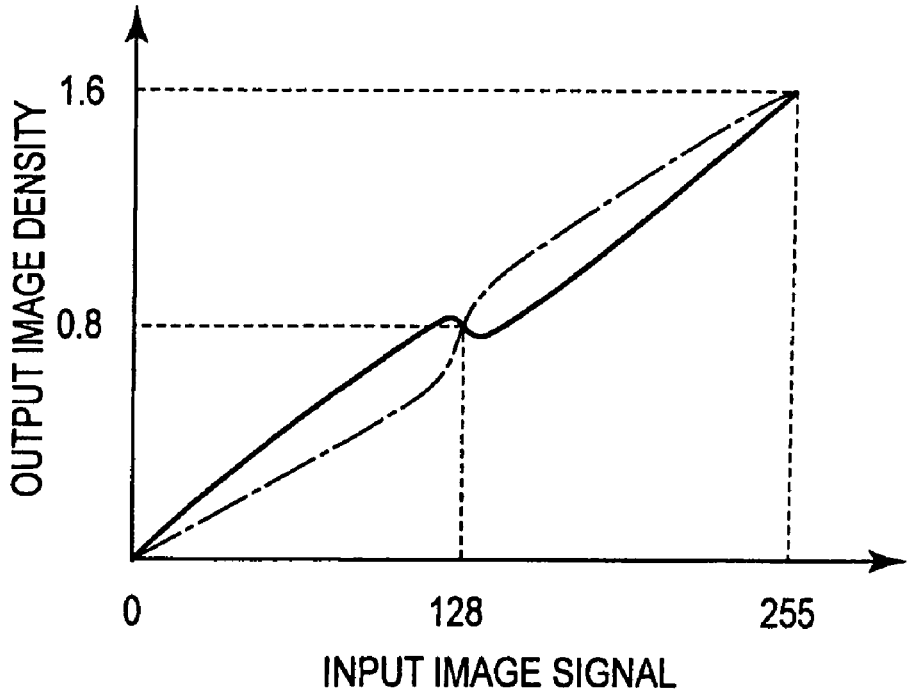
FIG. 6 is a graph showing the effect of the changes in image formation conditions and/or ambient conditions upon the relationship between the value of the input video signals, and the density levels of the images resulting from the input video signals.

However, as a large number of copies are made, that is, the image forming operation is repeated a large number of times, and/or the ambient conditions of the image forming apparatus change, the image formation conditions, such as the developmental properties of the developing means 4 and 5, the thickness of the dielectric layer of the photosensitive drum 1, the transfer efficiency or the like in the secondary transfer station 11, change. As a result, the light and deep color toners change in the $\gamma$ property, making nonlinear the relationship between input image density level and output image density level, roughly at the density level (which hereinafter will be referred to as mid image density level) where the light color toner and deep color toner begin to be used in mixture, as shown in FIG. 6. Therefore, it becomes unlikely for an image satisfactory in terms of color density reproduction to be formed. Instead, an unsatisfactory image, for example, an image unnatural in gradation across the areas where color density is in the mid range, an image suffering from pseudo-contours, or the like, is likely to be yielded.

In this embodiment, therefore, the image density levels to be inputted for forming the images of the density level detection test patches for revising the LUT are selected so that the detection of the density levels of the patch images, the density levels of which are at, or in the adjacencies of, the mid image density level, is prioritized.

Figure 7:
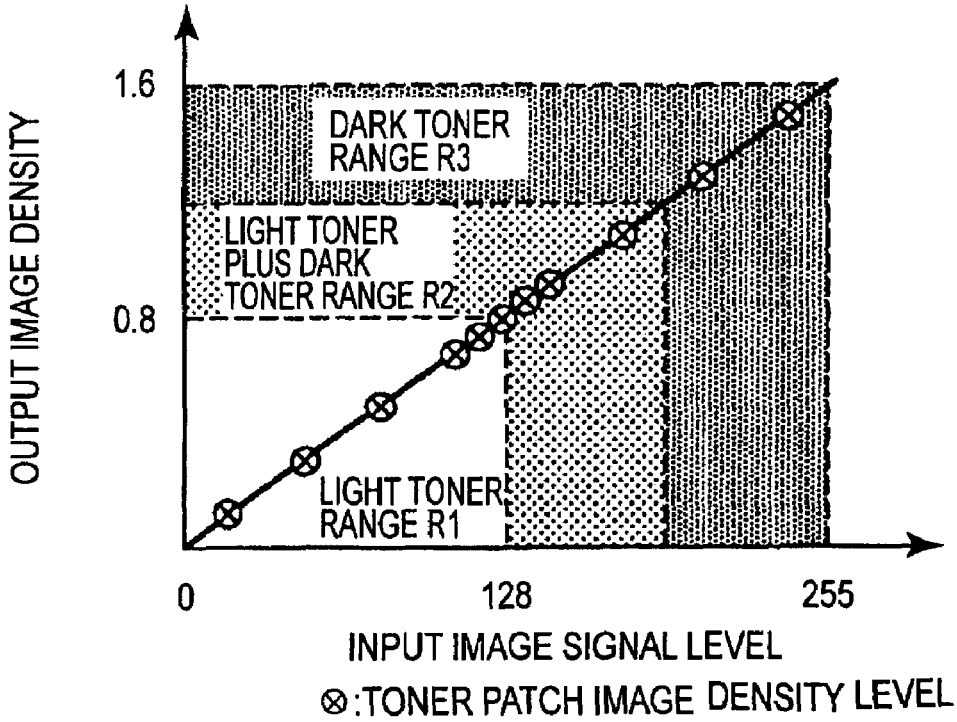
FIG. 7 is a graph showing the relationship between the values of the input video signals generated for the formation of the density level test patches, and the density levels of the images of the test patches resulting from the input video signals for the formation of the density level test patches.

In this embodiment, as the values for the video signals to be inputted to form the patch images for determining the relationship between the input signal level and the output density level, 16, 48, 80, 112, 120, 128, 136, 144, 176, 208, and 240 are selected from among the 255 values (that is, 256 gradation levels) used to indicate the density level of an image of a solid color. FIG. 7, in which the abovementioned values for the video signals inputted for patch formation, and the corresponding density levels of the patch images, are plotted, shows the relationship between the input signals and output signals in terms of the image density. As will be evident from this graph, the values for the input video signal are selected so that the interval between the adjacent two values is smaller, near 128; in other words, the detection of the density level is concentrated to the values near 128.

More specifically, the above-mentioned values are selected in consideration of the following facts (problems). That is, not only is it difficult to confirm whether or not the relationship between the input video signal and the density level of the resultant image is linear in the areas of the image, where the density is in the mid range, but also, if the larger the interval between the adjacent two density levels selected for the density level detection test patches, the more unclear the changes in the γ property, whereas, the narrower the interval, the greater the number of the patch images to be formed to detect the relationship between the input video signals and the density level of the resultant image, and therefore, the longer the down time, or the time spent to detect the relationship, and also, the greater the toner consumption, and therefore, the higher the image formation cost.

More specifically, the number by which the patch images, which are formed of the mixture of the light and deep color toners, and the image density levels of which are in the adjacencies of the borderline density level between the density level range in which patch images are formed of the light color toner alone, and the density level range in which patch images are formed of the mixture of the light and deep color toners, are formed, and the number by which the patch images, which are formed of the mixture of the light and deep color toners, and the image density levels of which are in the adjacencies of the border line density level between the density level range in which patch images are formed of the mixture of the light and deep color toners, and the density level range in which patch images are formed of the deep color toner alone, are formed, are made greater than the number by which the patch images which are formed with the use of the deep color toner alone, and the density levels of which are in the mid to high portion of the density level range in which patch images are formed of the deep color toner alone, are formed, and the number by which the patch images, which are formed of the light color toner alone, and the density levels of which are in the low to mid portion of the density level range in which patch images are formed of the light color toner alone, are formed.

As described above, it is desired that the patch images, the image density levels of which fall within the adjacencies of the mid density level at which the toner used for forming a monochromatic image is switched from the light color toner to the mixture of the light and deep color toners, are formed by a greater number than the patch images, the image density levels of which do not fall within the abovementioned range, and their actual density levels are detected.

Figure 8:
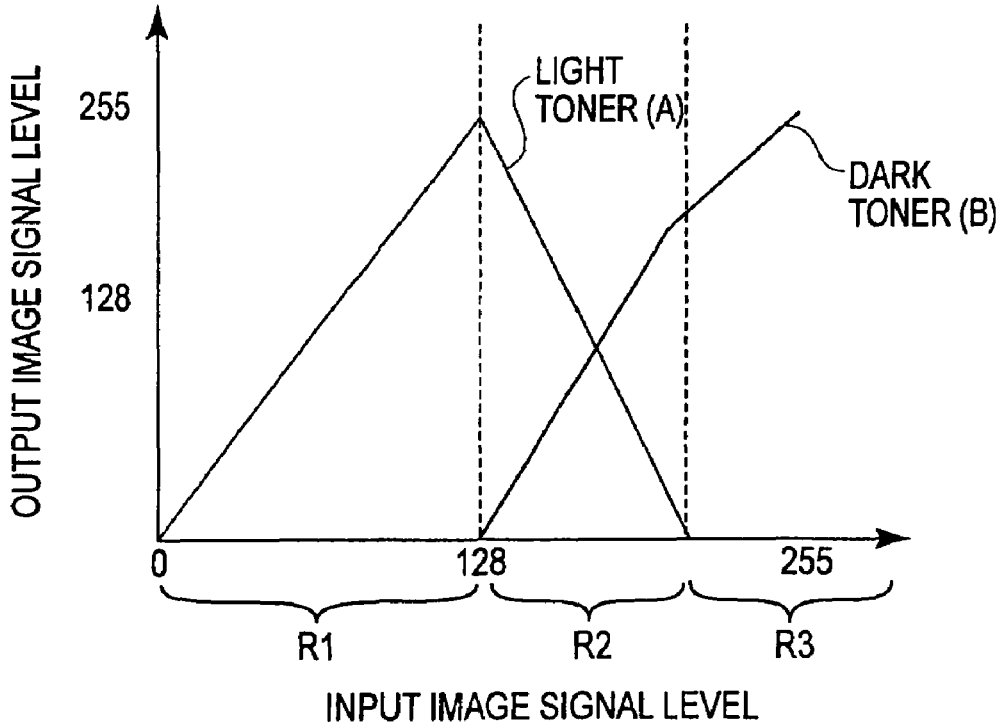
FIG. 8 is a graph showing the LUT for the light color toner, and the LUT for the deep color toner, in the first embodiment.

Refeffing to FIG. 8, in which in order to make it easier to understand the above-mentioned mid density levels, the overall range of the values for the input video signals are divided into an image density range R1 in which only the light color toner is used, an image density range R2 in which the mixture of the light and deep color toners are used, and an image density range R3 in which only the deep color toner is used. The above-mentioned mid density level means the borderline between the image density ranges R1 and R2.

In other words, the patch images, the theoretical density levels of which fall within the adjacencies of the borderline between the image density ranges R1 and R2, are formed by a larger number than the patch images, the theoretical density levels of which do not fall therein, and their actual density levels are detected by the density sensor 21 to more precisely determine the relationship between the input density and output density. Therefore, it is possible to keep linear the relationship between the input density level and output density level. In other words, it is possible to satisfactorily control the image density.

Figure 9:
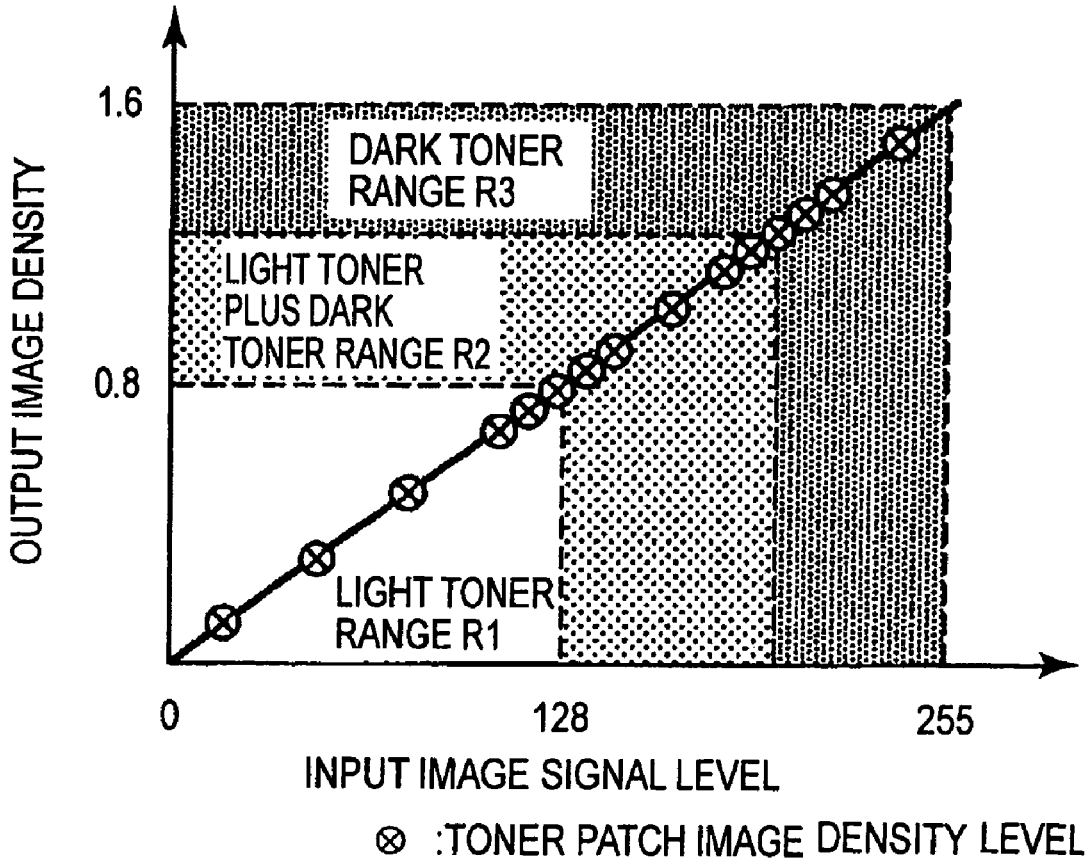
FIG. 9 is a graph showing the relationship between the values of the input video signals generated for the formation of the density level test patches, and the density levels of the images of the test patches resulting from the input video signals for the formation of the density level test patches.

Referring to FIG. 9, regarding one of the characteristic features of this embodiment of the present invention, the image density can be even more satisfactorily controlled by forming, by a greater number, the patch images, the theoretical density levels of which fall within the adjacencies of the borderline between the image density ranges R2 and R3, in addition to the patch images, the theoretical density levels of which fall within the adjacencies of the borderline between the image density ranges R1 and R2, than the patch images, the theoretical density levels of which do not fall therein.

The reason not only are the patch images, the image density levels of which fall within the adjacencies of the intermediary density level, that is, the borderline between the image density ranges R1 and R2, that is, the borderline between the image density range in which only the light color toner is used, and the image density range in which the light color toner is used in combination with the deep color toner, but also, the patch images, the image density levels of which fall within the adjacencies of the intermediary density level, that is, the borderline between the image density ranges R2 and R3, are formed by a greater number than the patch images, the density levels of which do not fall in the adjacencies of the borderline between the image density ranges R1 and R2, and the adjacencies of the image density range R2 and R3, is that the effects of the changes which occur to the developing means through the usage, upon the γ property, and the effects of the changes in the ambient conditions, upon the γ property, are larger when the image density level of the portion of the image being formed is at or in the adjacencies of these borderlines.

As will be evident from the above description of this embodiment, in the case of the image forming apparatus, in which each of the plurality of monochromatic images, different in color, are used to form a single multicolor image, the image is formed of two toners, that is, light and deep color toners, which are the same in hue, but are different in color density. The image density is controlled by revising the LUT in response to the output of the density sensor, which detects the image density levels of the images of the density level detection test patches, the formation of the patch images, the image density levels of which fall in the adjacencies of the image density level at which the toner used for the formation of the monochromatic image is switched from the light color toner to the mixture of the light and deep color toners, is prioritized. The density levels of the resultant patch images are detected by the density sensor. Therefore, even if the processing conditions of the image forming apparatus change due to the formation of a large number of images (copies), and/or the ambient conditions change, the relationship between the video signals and the density level of the image resulting from the video signals remains linear, making it possible to always form a color image of high quality.

Embodiment 2

Next, referring to FIG. 10, the second embodiment of the present invention will be described.

In this embodiment, the image formation stations Pb and Pc for forming the magenta (M) and cyan (C) images are provided with both the first and second developing means 4 and 5 in the above described first embodiment, and the image formation stations Pa and Pd for forming the yellow (Y) and black (Bk) images are provided with only the second developing means 5, that is, the developing means which uses the deep color toner.

Yellow (Y) color is higher in brightness. Therefore, the graininess of the yellow areas of an image is difficult to visually detect, even if the areas are low in density. Thus, the effect of the usage of the light yellow toner is insignificant.

As for black (Bk) color, it is rare that photographic image or the like images, which require high quality, have black areas which are low in density. Further, a letter or the like image usually is solid. Therefore, effect of the usage of the light black toner is insignificant.

In this embodiment, the process of forming a magenta (M) image and the process of forming a cyan (C) image are controlled in a manner similar to that in the first embodiment. As a result, the relationship between the input video signal and the density level of the resultant image can be kept linear, making it possible to yield a color image of high quality, in terms of the density of the magenta and cyan color areas of the image, regardless of the changes in the ambient conditions, even after the developing apparatuses change in properties through usage.

Moreover, the component count of the developing means is smaller than that in the first embodiment, and also, the memory capacity necessary for the LUT can be reduced. Therefore, it is possible to provide an image forming apparatus, which is smaller, lower in cost, and simpler to control.

Embodiment 3

Next, referring to FIG. 11, the third embodiment of the present invention will be described. The general structure of the image forming apparatus in this embodiment is the same as that of the image forming apparatus in the first embodiment, and therefore, the same referential numbers and symbols as those used for the designation of the components, means, etc., of the image forming apparatus in the first embodiment are used to designate the corresponding component, means, etc., of this image forming apparatus.

In this embodiment, the density of the patch image formed to control the image forming apparatus in terms of image density is detected by the density sensor 21 positioned next to the intermediary transfer member 12, facing the intermediary transfer member 12. In this embodiment, however, the density level of the test patch image is detected by the original reading portion 20 after the test patch image is transferred onto the recording medium p, and the control is carried out in response to the thus detected image density level of the test patch image.

Figure 11:
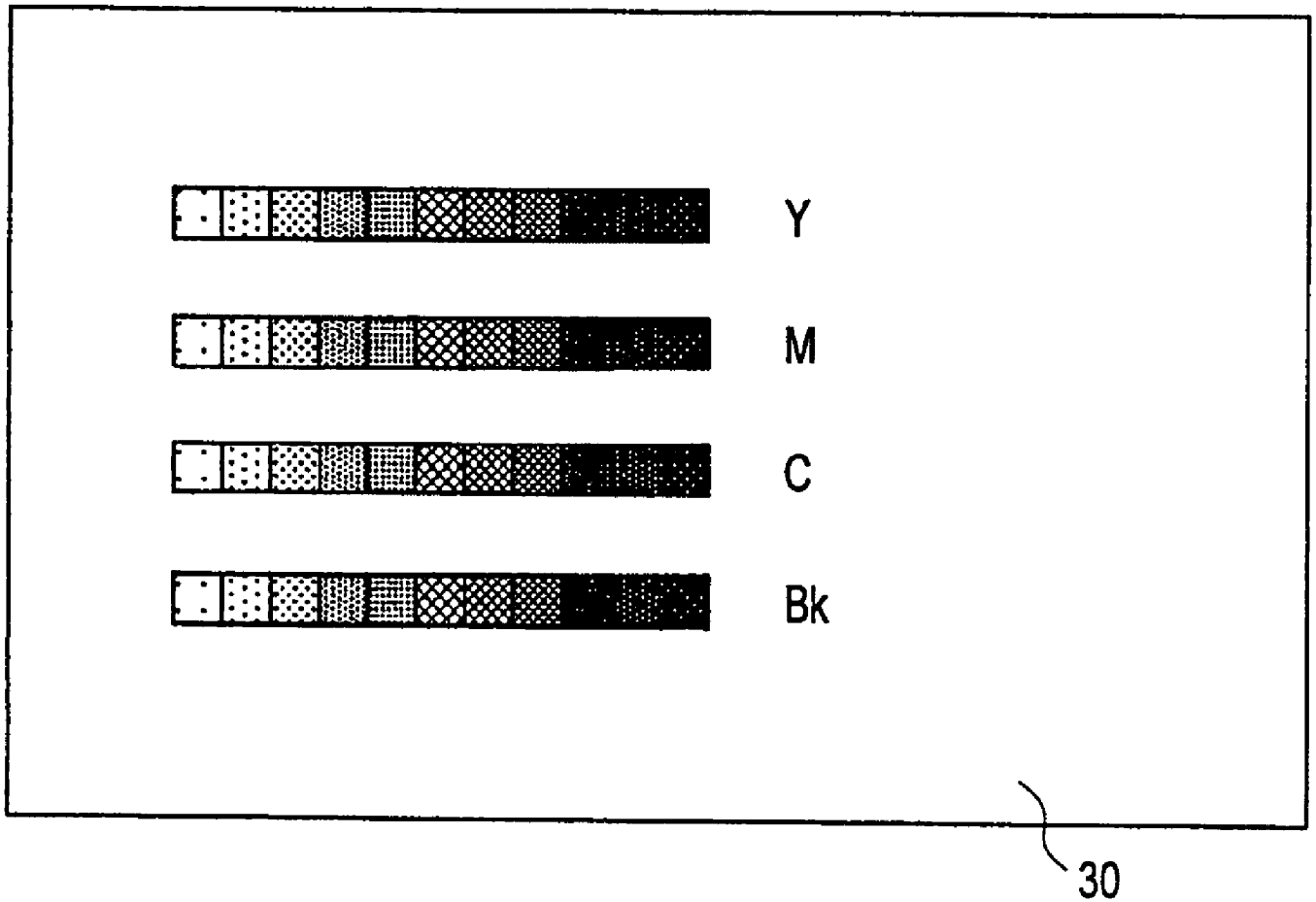
FIG. 11 is a picture of the density level detection test patches in the third embodiment.

Refeffing to FIG. 11, a test pattern print 30 contains four rows of color patches, a row of eleven yellow color patches, a row of eleven magenta color patches, a row of eleven cyan color patches, and a row of eleven black color patches. The eleven color patches in each row of color patches are different in density level (gradation levels). Out of the 256 levels of density (gradation levels), which this image forming apparatus is enabled to reproduce, the mid density value and the values close thereto are primarily selected as the values for the density levels for the density level detection test patches. The images of the density level detection test patches, the density levels of which fall in the low density range or high density range, are formed by a substantially smaller number than the number by which the images of the density level detection test patches, the density levels of which fall on or within the adjacencies of the mid density value are formed.

Thus, the images of the density detection test patches are not formed by an excessive number. Therefore, it is possible to control the image forming apparatus in terms of the density level at which the toner used for the formation of a monochromatic image is switched from the light color toner to the mixture of the light and deep color toners, while reducing the toner consumption and the time required for forming the test prints.

As for the image density levels of the eleven test patches in each of the four rows of test patches, the density level of the test patch, which is deepest in density, is represented by a value of 255, and the values of the density levels of the eleven test patches for each color are 16, 48, 80, 112, 120, 128, 136, 144, 176, 208, and 240, as they were in the first embodiment. The video signals for forming the images of these eleven test patches, the density levels of which have the above listed values, one for one, are generated with the use of the test patch generating means.

After the formation of the groups of patch images, the groups of patch images on the test print 30 are read by the original reading portion 20.

In order to accurately detect the density level of the images of the test patches, the density level of each test patch image was detected at 16 points of the test patch, and the obtained signals were averaged. Based on the values obtained by averaging the 16 values obtained by detecting the density level of each test patch image at 16 different points of the test patch image, RGB signals are converted by the optical density converting method into the density values for Y, M, C, and Bk. The LUT is revised in response to the thus obtained density values for Y, M, C, and Bk and a new LUT is set up.

By carrying out the above described image density control, it was possible to maintain linearity in the relationship between the input video signals and the density level of the reproduced image, in spite of the changes in the processing conditions which occurred through an operation for forming a large number of copies, repetition of the image forming operations, and/or changes in the ambient conditions. As a result, it was possible to continuously form images of high quality.

Further, the test patch images tested for image density control in this embodiment are the test patch images which had been transferred onto the recording mediums p, and had been fixed to the recording mediums p by being put through the fixing device 9. They are virtually the same in terms of image density level as that of the image to be formed for actual usage. Thus, the image density control in this embodiment is more accurate than that in the first embodiment.

Figure 10:
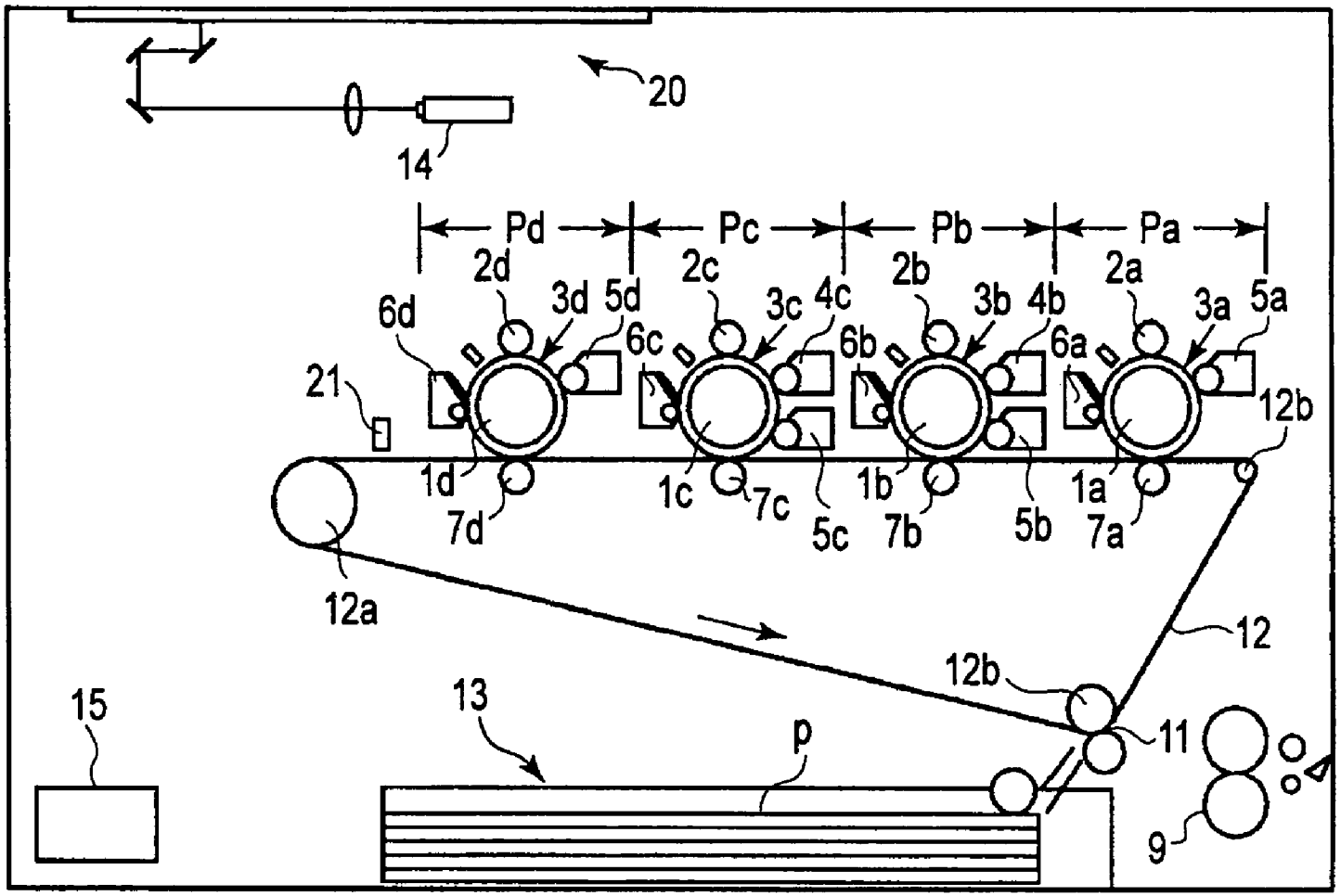
FIG. 10 is a schematic drawing of the image forming apparatus in the second embodiment, showing the general structure thereof.

Referring to FIGS. 1 and 10, in the first to third embodiments, the density sensor 21 was positioned so that it faced the intermediary transfer member 12, which was a transfer belt for a multilayer direct image transfer method. Obviously, however, the density sensor 21 may be positioned so that it faces the peripheral surface of the photosensitive drum 1. Placing the density sensor 21 so that it faces the peripheral surface of the photosensitive drum 1 is just as effective as placing the density sensor 21 so that it faces the intermediary transfer member 12.

Embodiment 4

Figure 12:
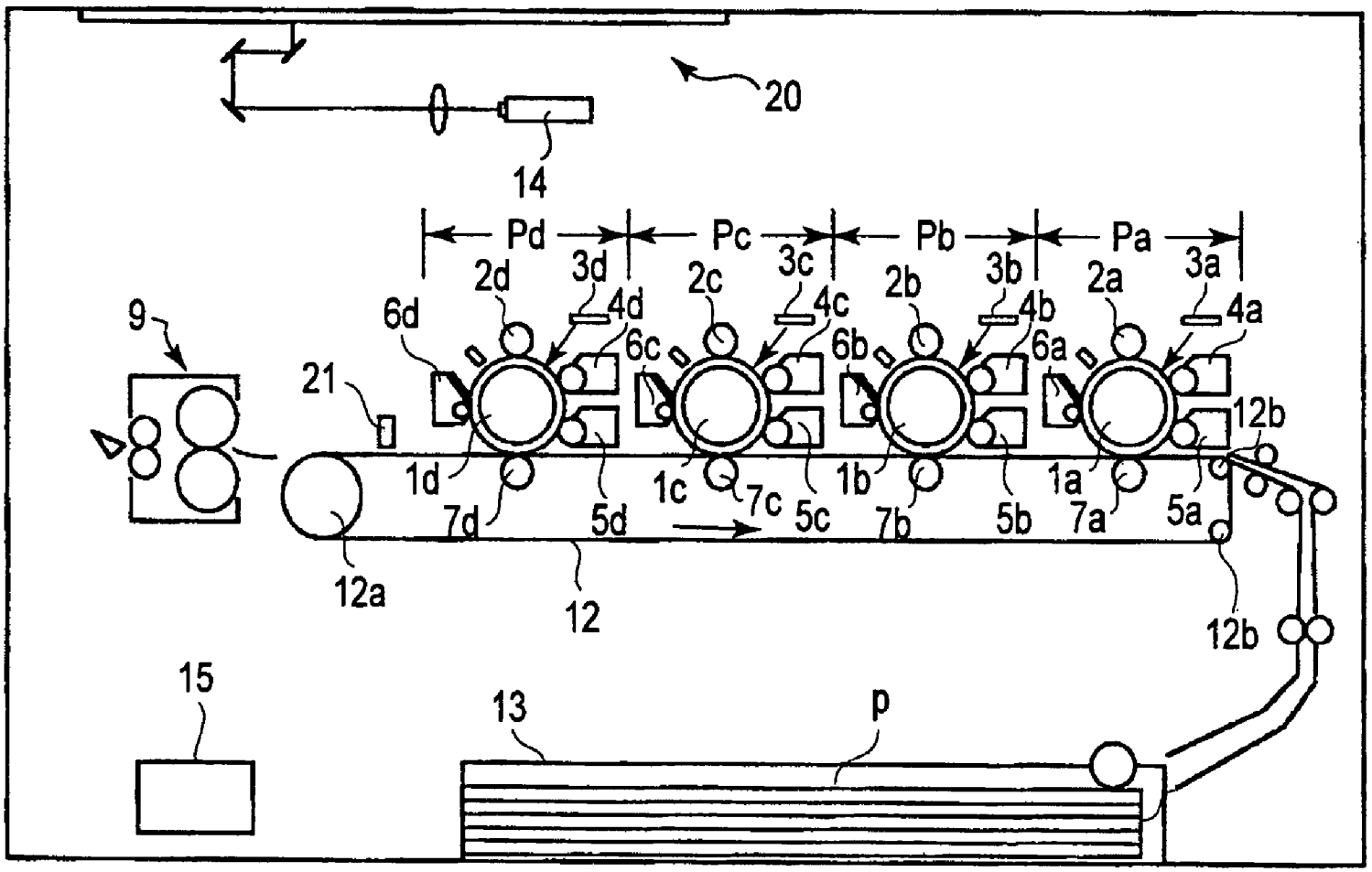
FIG. 12 is a schematic drawing of the image forming apparatus in the fourth embodiment, showing the general structure thereof.
Figure 13:
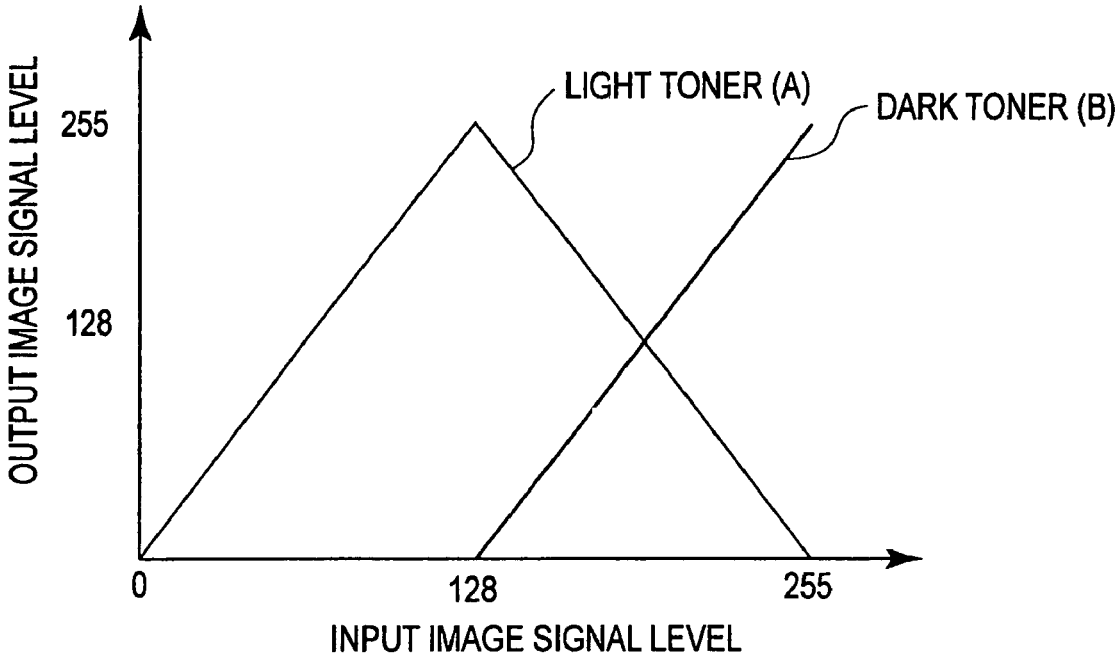
FIG. 13 is a graph showing the LUT for the light color toner, and the LUT for the deep color toner, for an image forming apparatus in accordance with the prior art.

Next, referring to FIG. 12, the fourth embodiment of the present invention will be described.

This embodiment is an example of the application of the present invention to an image forming apparatus employing the multilayer direct image transferring method. In this embodiment, a plurality of image formation stations Pa–Pd, similar in structure as those shown in FIG. 1, are disposed along the transfer belt 12. The recording medium p from a cassette 13 is borne on the surface of the transfer belt 12, and is conveyed by the transfer belt 12 through the image formation stations Pa–Pd, in which it remains pinched between the transfer roller 7 as a transferring means, and the photosensitive drum 1, so that the a plurality of monochromatic toner images are transferred in layers directly onto the recording medium p. After the direct transfer, the recording medium p is conveyed through the fixing device 9, in which the plurality of monochromatic toner images on the recording medium p are fixed. Thereafter, the recording medium p is discharged frog the image forming apparatus. Obviously, a plurality of image formation stations Pa–Pd, similar to those shown in FIG. 10, may be disposed along the transfer belt 12.

In this embodiment, the images of the density level test patches are formed on the portion of the transfer belt 12 other than where the recording medium p is borne, or on the recording medium p borne on the transfer belt 12. Then, the test patch images are tested for density level by the density sensor 21. The image control in this embodiment is the same as those in the above-described first to third embodiments.

According to the above described first to fourth embodiments, it is possible to keep linear the relationship between the input video signals and the density levels of the resultant images, even if the condition of an image forming apparatus changes because of the formation of a large number of images, and/or the changes in the ambient conditions. Therefore, it is possible to always form images of high quality.

Incidentally, in the above, the first to fourth embodiments were described with reference to an image forming apparatus of an inline type. However, the number of photosensitive drums does not need to be limited to the number in these embodiments. For example, a plurality of developing means may be disposed in the adjacencies of the peripheral surface of a single photosensitive drum.

Further, the measurements, materials, and shapes of the structural components of the image forming apparatus, and the positional relationship among them, in the first to fourth embodiments of the present invention, are not intended to limit the scope of the present invention, unless specifically noted.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 433950/2003 filed Dec. 26, 2003, which is hereby incorporated by reference.

What is claimed is:

1. An image forming apparatus comprising:

image forming means for forming an image in accordance with image information using a plurality of developing means, wherein at least one of the developing means contains light color toner, and at least one other developing means contains dark color toner having the same hue as the light color toner;

patch image forming means for forming, by said image forming means, a patch image with the light color toner and the dark color toner, the patch image having different image density level portions, wherein a difference in image density levels between adjacent image density level portions in a transition range before and after a switching region between a range in which either one of the light color toner or the dark color toner is used and a range in which both of the light color toner and the dark color toner are used is smaller than a difference in image density levels in the other ranges;

density detecting means for detecting densities of the patch image; and image density control means for image density control in accordance with an output of said density detecting means.

2. An apparatus according to claim 1, wherein the light color toner provides an optical density less than 1.0 per 0.5 $mg/cm^2$ of the toner on a recording material after the toner image is fixed, and the dark color toner provides an optical density of not less than 1.0 per 0.5 $mg/cm^2$ of the toner on the recording material after the toner image is fixed.

* * * * *

UNITED STATES PATENT AND TRADEMARK OFFICE

CERTIFICATE OF CORRECTION

PATENT NO. : 7,209,673 B2
APPLICATION NO. : 11/018858
DATED : April 24, 2007
INVENTOR(S) : Suzuki et al.

It is certified that error appears in the above-identified patent and that said Letters Patent is hereby corrected as shown below:

COLUMN 1:
Line 15, “yellow Y,” should read --yellow (Y),--.
Line 47, “refeffed” should read --referred--.

COLUMN 2:
Line 17, “coffesponds” should read --corresponds--.
Line 43, “the-preferred” should read --the preferred--.
Line 51, “showing-the” should read --showing the--.

COLUMN 4:
Line 27, “toilers” should read --toners--.

COLUMN 8:
Line 1, “Refeffing” should read --Referring--.
Line 8, “refeffed” should read --referred--.

COLUMN 9:
Line 31, “also, if the” should read --also, the--.

COLUMN 10:
Line 7, “Refeffing” should read --Referring--.

COLUMN 12:
Line 4, “Refeffing” should read --Referring--.
Line 51, “Bk and” should read --Bk, and--.

UNITED STATES PATENT AND TRADEMARK OFFICE

CERTIFICATE OF CORRECTION

PATENT NO. : 7,209,673 B2
APPLICATION NO. : 11/018858
DATED : April 24, 2007
INVENTOR(S) : Suzuki et al.

It is certified that error appears in the above-identified patent and that said Letters Patent is hereby corrected as shown below:

COLUMN 13:
Line 32, "discharged frog" should read --discharged from--.

Signed and Sealed this

Third Day of March, 2009

JOHN DOLL
*Acting Director of the United States Patent and Trademark Office*